US008587489B2

(12) United States Patent
Oung et al.

(10) Patent No.: US 8,587,489 B2
(45) Date of Patent: Nov. 19, 2013

(54) DYNAMIC EAS DETECTION SYSTEM AND METHOD

(75) Inventors: Harry Oung, Cherry Hill, NJ (US); Kefeng Zeng, Mantua, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 704 days.

(21) Appl. No.: 12/134,827

(22) Filed: Jun. 6, 2008

(65) Prior Publication Data

US 2008/0303673 A1 Dec. 11, 2008

Related U.S. Application Data

(60) Provisional application No. 60/942,873, filed on Jun. 8, 2007.

(51) Int. Cl.

| | |
|---|---|
| ***H01Q 7/08*** | (2006.01) |
| ***H01Q 11/18*** | (2006.01) |
| ***H01Q 21/00*** | (2006.01) |
| ***G08B 13/22*** | (2006.01) |

(52) U.S. Cl.
USPC ..... 343/742; 343/788; 343/867; 340/572.7

(58) Field of Classification Search
USPC ..... 343/742, 788, 867; 340/572.7, 10.1
See application file for complete search history.

(56) References Cited

U.S. PATENT DOCUMENTS

| | | | |
|---|---|---|---|
| 3,673,517 | A | 6/1972 | Ticknor |
| 4,016,553 | A | 4/1977 | Novikoff et al. |
| 4,063,229 | A | 12/1977 | Welsh et al. |
| 4,135,183 | A | 1/1979 | Heltemes |
| 4,243,980 | A | 1/1981 | Lichtblau |
| 4,260,990 | A | 4/1981 | Lichtblau |
| 4,373,163 | A | 2/1983 | Vandebult |
| 4,679,046 | A | 7/1987 | Curtis et al. |
| 4,866,455 | A | 9/1989 | Lichtblau |
| 5,049,857 | A | 9/1991 | Plonsky et al. |
| 5,430,511 | A | 7/1995 | Paff et al. |
| 5,764,187 | A | 6/1998 | Rudish et al. |

(Continued)

FOREIGN PATENT DOCUMENTS

| | | |
|---|---|---|
| EP | 0186483 | 7/1986 |
| EP | 0579332 | 1/1994 |

(Continued)

OTHER PUBLICATIONS

International Search Report for corresponding PCT Application No. PCT/US2008/066159, dated Jan. 26, 2009.

(Continued)

*Primary Examiner* — Michael C Wimer
(74) *Attorney, Agent, or Firm* — Caesar, Rivise, Bernstein, Cohen & Pokotilow, Ltd.

(57) ABSTRACT

This invention relates to dynamically controlled, electronic article surveillance (EAS) systems whereby an array of antenna elements is digitally phased and actively driven for concurrent transmission, and digitally phased and combined in the receiver unit to improve security tag detection. In particular, the individual frequency and phase of the plurality of the transmit/receive signals are rapidly varied to allow for automated manipulation (steering) of the transmit field pattern and receive field sensitivity. It is the object of this invention to achieve the following features via means of digital phasing and dynamic computer control: sufficient far-field cancellation, null-free detection and uncompromised detection performance regardless of tag's orientation.

10 Claims, 20 Drawing Sheets

(56) References Cited

U.S. PATENT DOCUMENTS

| | | | | |
|---|---|---|---|---|
| 5,907,221 | A | 5/1999 | Sato et al. | |
| 6,020,856 | A | 2/2000 | Alicot | |
| 6,060,988 | A | 5/2000 | Copeland et al. | |
| 6,081,238 | A | 6/2000 | Alicot | |
| 6,166,706 | A | 12/2000 | Gallager, III et al. | |
| 6,388,628 | B1 * | 5/2002 | Dettloff et al. | 343/742 |
| 6,517,000 | B1 | 2/2003 | McAllister et al. | |
| 6,578,202 | B1 | 6/2003 | Holland | |
| 6,603,391 | B1 | 8/2003 | Greeff et al. | |
| 6,700,490 | B2 | 3/2004 | Frederick | |
| 6,836,216 | B2 | 12/2004 | Manov et al. | |
| 7,183,922 | B2 * | 2/2007 | Mendolia et al. | 340/572.1 |
| 7,301,459 | B2 | 11/2007 | Frederick et al. | |
| 7,317,426 | B2 * | 1/2008 | Copeland et al. | 343/788 |
| 7,420,463 | B2 | 9/2008 | Copeland et al. | |
| 2001/0038332 | A1 | 11/2001 | Rodgers et al. | |
| 2002/0157070 | A1 | 10/2002 | Embling et al. | |
| 2003/0210145 | A1 | 11/2003 | Manov et al. | |
| 2005/0253720 | A1 | 11/2005 | Oakes et al. | |
| 2006/0132312 | A1 | 6/2006 | Tavormina | |
| 2008/0014790 | A1 | 1/2008 | Montena | |
| 2008/0303673 | A1 | 12/2008 | Oung et al. | |

FOREIGN PATENT DOCUMENTS

| | | |
|---|---|---|
| EP | 0608961 | 8/1994 |
| EP | 0628937 | 12/1994 |
| EP | 0645840 | 3/1995 |
| EP | 0663657 | 7/1995 |
| EP | 1041503 | 10/2000 |
| EP | 1128464 | 8/2001 |
| EP | 1357635 | 10/2003 |
| EP | 1602939 | 12/2005 |
| EP | 1693778 | 8/2006 |
| EP | 1727235 | 11/2006 |
| EP | 1596346 | 7/2008 |
| WO | 2005119615 | 12/2005 |
| WO | WO2008/154404 | 12/2008 |

OTHER PUBLICATIONS

International Search Report for related PCT Application No. PCT/US2009/055332 dated Feb. 11, 2010.

Partial International Search Report for corresponding PCT Application No. PCT/US2008/066159.

* cited by examiner

DYNAMIC EAS DETECTION SYSTEM AND METHOD

CROSS-REFERENCE TO RELATED APPLICATIONS

This utility application claims the benefit under 35 U.S.C. §119(e) of Provisional Application Ser. No. 60/942,873 filed on Jun. 8, 2007 entitled DYNAMIC EAS DETECTION and whose entire disclosure is incorporated by reference herein.

BACKGROUND OF THE INVENTION

1. Field of Invention

This invention relates to dynamically controlled, digitally-phased, multiple antenna elements for generating a dynamically enhanced electromagnetic field for orientation-independent tag detection and digital synthesis techniques which improves signal sensitivity of electronic article surveillance (EAS) systems.

2. Description of Related Art

An electronic article surveillance (EAS) system typically consists of (a) tags, (b) interrogation antenna(s), and (c) interrogation electronics, each playing a specific role in the overall system performance.

An EAS loop antenna pedestal(s) is typically installed near the exit of a retail store and would alarm upon the unauthorized removal of an article from the store, based on the detection of a resonating tag secured to the article. The system comprises a transmitter unit for generating an electromagnetic field adjacent to the pedestal, and a receiver unit for detecting the signal caused by the presence of the resonating tag in the interrogating field.

Some desired features in EAS include: no blind spot or null region exists in the detection zone; the interrogating field be sufficiently strong near the antenna for detecting the presence of a resonating tag in noisy environment, but sufficiently weak far away for regulatory compliance, and; the detection performance be unaffected by the orientation of the resonating tag.

One approach to suppress far field emission is to mechanically twist an O-loop antenna 180° in the middle to form an 8-loop. However, a detection null is created in the area near the intersection of the figure eight crossover due to the magnetic field lines running in parallel to the plane of the tag. This causes significantly reduced detection as optimal detection is achieved when the magnetic field lines run perpendicular to the plane of the tag.

Another approach, EP 0 186 483 (Curtis et al.), utilizes an antenna system that includes a first O-loop antenna and a second 8-loop antenna which is coplanar to the first. In such an arrangement, a circular-polarized, interrogating field is created when both antennas are driven concurrently with a phase shift such that the energy received by the tag is the same regardless of its orientation.

A different antenna structure, disclosed in EP 0 579 332 (Rebers), comprises two-loop antenna coils, wherein one coil is part of a series resonance circuit and the other coil is part of a parallel resonance circuit; the series and parallel resonance circuits are interconnected to form an analog phase-shift network which is driven by a single power source.

An equivalent analog phase-shift network is incorporated in EP 1 041 503 (Kip) that relates to a phase insensitive receiver for use in a rotary emission field.

Another approach, U.S. Pat. No. 6,166,706 (Gallagher III, et al.), generates a rotating field comprising of a magnetically coupled center loop located coplanar to an electrically driven 8-loop while overlapping a portion or both of the upper and lower 8-loops. With this antenna configuration, magnetic induction produces a 90° phase difference between the phase of the 8-loop and the phase of the center loop such that a rotary field is created.

In U.S. Pat. No. 6,836,216 (Manov, et al.), the direction of current flow in four antenna coils is separately controlled to generate a resultant magnetic field that is polarized in some preferred orientations (vertical, perpendicular, or parallel to the exit aisle) within the interrogation zone.

A plurality of antenna configurations is described in U.S. Pat. No. 6,081,238 (Alicot) whereby the antennas are phased 90° apart from each other to improve the interrogating field distribution.

EAS systems often utilize resonance effects, such as magnetoelastic resonance (e.g. acoustomagnetostrictive or AM) and electromagnetic resonance (RF coil tag). EAS tags exhibit a second-order response to an applied excitation, and the resonance behavior is mathematically described by an impulse response and a frequency response. The impulse response and frequency response from a Fourier transform may be used in two alternative means of tag interrogation: pulse-listen interrogation and swept-frequency interrogation.

EAS antennas are electrically small when compared to the wavelength at the operating frequency, typically below 10 MHz, and the interrogation zone which is within the near-field region, where the inductive coupling dominates. Planar loops are most commonly used because of its simplicity and low cost. Tag excitation requires the magnetic flux to be substantially tangential to the length of an AM tag and perpendicular to an inductive coil tag. A single antenna loop element inevitably generates an uneven interrogation zone with respect to tag position and orientation. In practice, at least two antenna elements are used to switch the field direction, thus creating a more uniform interrogation zone.

Previous solutions to the orientation problem include either simultaneously phasing or sequentially alternating multiple antenna elements.

EP 0 186 483 (Curtis, et al.) discloses an antenna structure (see FIG. 1) comprising a figure-8 loop (or 2-loop) element 11 and an O-loop (or 1-loop) element 12 that, when driven 90° out of phase, generates a constantly rotating field. Curtis's antenna structure is not well balanced, as the 0 loop generates a significantly larger field than the figure-8 loop.

EP 0 645 840 (Rebers) proposes an improved structure (see FIG. 2) that uses 2-loop element 14 and a 3-loop element 13. The 3-loop also has an advantage over the 1-loop (of FIG. 1) in terms of far-field cancellation, although it was not a concern in both Curtis's and the EP 0 645 840 (Rebers) inventions. For continuous transmission where the received signal is in the form of modulation on the carrier signal, the phase of the received signal is sensitive to tag orientation. Synchronous demodulation, or phase-sensitive detection, will not work well with a rotating field that in effect constantly rotates the tag. Quadrature receiver calculation is required to eliminate the phase-sensitivity.

EP 1 041 503 (Kip) discloses a receiver (see FIG. 3) that addresses the phase-sensitivity issue.

U.S. Pat. No. 6,081,238 (Alicot) discloses an antenna structure (see FIG. 4) that uses two adjacent coplanar single loops, where the mutual coupling introduces a phase-shift of 90°, thus creating a relatively null-free detection pattern. A practical issue with the phase-shift by means of mutual coupling is that it requires a high Q to induce 90° of phase shift between the two loops, leading to excessive ringing for pulse-listen interrogation. Also, the induced current on the coupling loop will not have as large amplitude as the current on the feeding loop, and the detection pattern will not be uniform for the two loops.

Disclosed in the same patent is a practical implementation (see FIG. 5) that alternates phase difference (either in phase or out of phase) between the two loops to switch field direction. The received signals from the two loops are shifted 90° for subsequent mixing. When the two antenna loops are in phase (during time interval A as shown in FIG. 6), there is no far-field cancellation.

Disclosed in the same patent is a solution by dividing the single loop into four equal-area elements assigned with phase of 0°, 90°, 180°, and 270°, as shown in FIG. 7.

The aforesaid methods and implementations have their specific issues and limitations. Curtis ignores the receiver and far-field cancellation. EP 0 579 332 (Rebers) uses RC phase-shifting circuit that not only introduces insertion loss but also causes resonance problems if used in a pulse-listen system. Also, RC phase-shifting circuit may not work well across a frequency range due to its limited bandwidth. For a pulse-listen system, it is simpler to sequentially alternate the 2-loop and 3-loop in terms of transmission and receiving. Alicot also uses phase-shifting circuit for quadrature receiver. As for far-field cancellation, Alicot divides the single loop into four equal-area elements. As detection performance is largely dependent upon the size of each loop element, the four-element antenna with far-field cancellation will have reduced detection compared to the two-element antenna without far-field cancellation.

All references cited herein are incorporated herein by reference in their entireties.

BRIEF SUMMARY OF THE INVENTION

It is the object of this invention to eliminate the analog phase-shifting circuit for both transmission and receiving, thus eliminating the insertion loss and hence improving the signal-to-noise ratio. The received signals from each antenna elements are digitized or processed using appropriate digital processing techniques.

Another object of this invention to increase the size of the antenna element while achieving substantial far-field cancellation for regulatory compliance.

For two elements driven 90° out of phase, the vector summation is not zero in far field, as shown in FIG. 8, and an additional far field cancellation technique is required.

An improved phasing method, of the present invention, are three antenna elements that, when driven 120° out of phase, result in zero vector summation in far field, as shown in FIG. 9.

An electronic article surveillance system is provided which comprises an antenna structure including three or more loops each connected to an independent transmission driver for generating a corresponding electromagnetic field wherein the transmission drivers are arranged to drive the loops in such a way that a vector sum of the electromagnetic fields of the independent transmission drivers is null in a far field and wherein no vector is separated from another vector by 180° of phase.

A dynamically controlled electronic article surveillance system for detecting security tags is provided wherein an array of antenna elements is digitally phased and actively driven for concurrent transmission to generate a plurality of electromagnetic fields having respective vectors and wherein the system changes the phases between each of the vectors for interacting with security tags for effecting tag detection.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
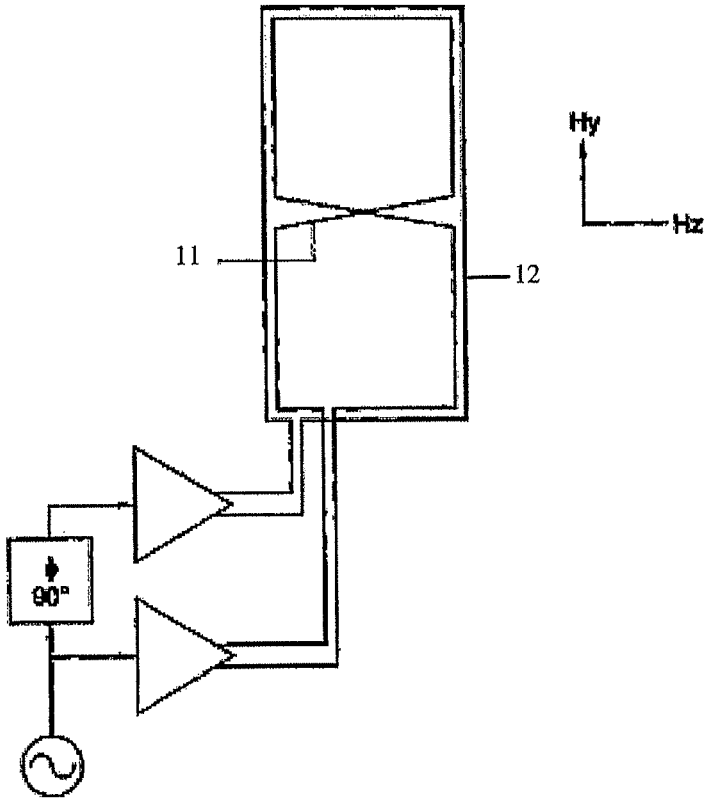
Fig. 1 (prior art)
FIG. 1 is a prior art antenna structure as depicted in EP 0 186 483 (Curtis)
Figure 2:
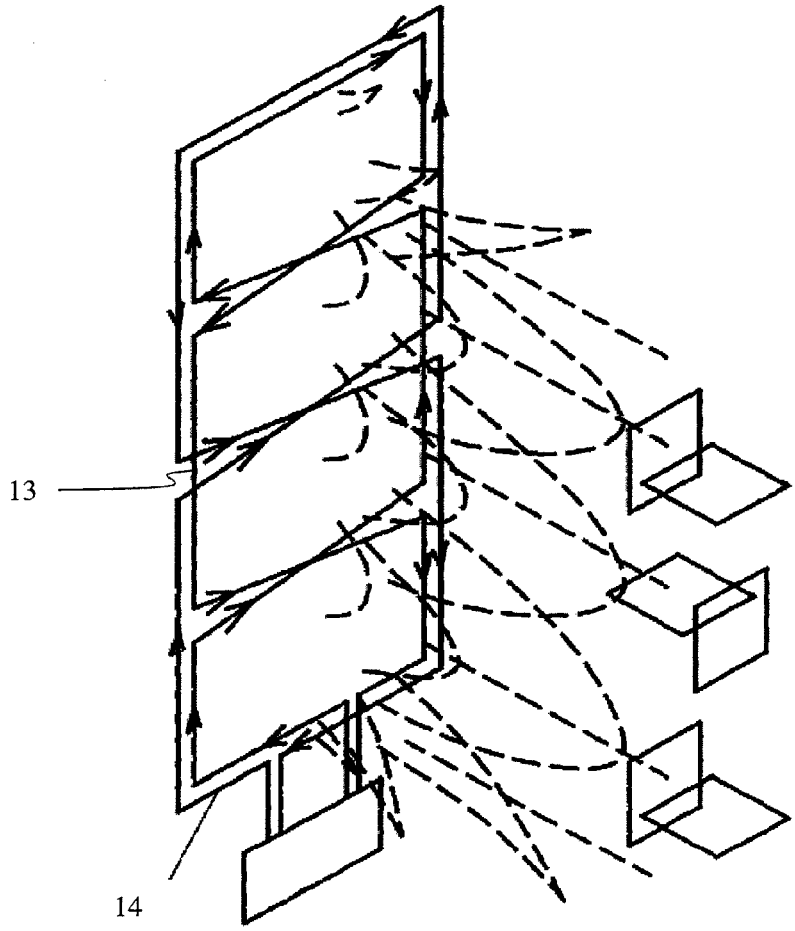
Fig. 2 (prior art)
FIG. 2 is another prior antenna structure as depicted in EP 0 645 840 (Rebers)
Figure 3:
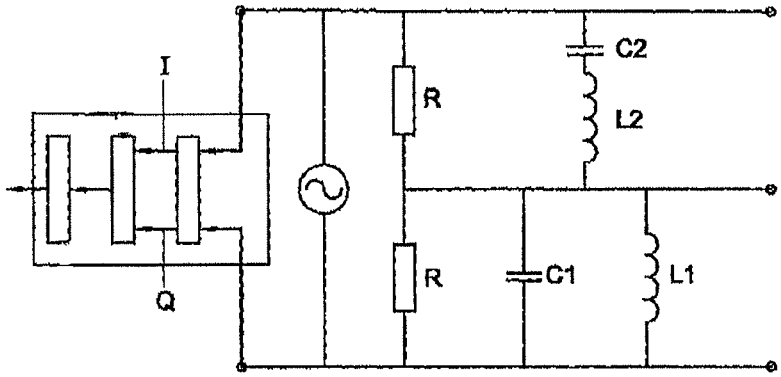
Fig. 3 (prior art)
FIG. 3 is a prior art receiver as depicted in EP 1 041 503 (Kip)
Figure 4:
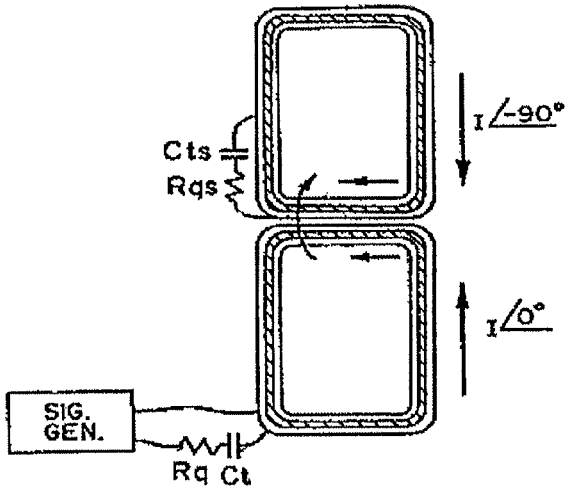
Fig. 4 (prior art)
FIG. 4 is another prior art antenna structure as depicted in U.S. Pat. No. 6,081,238 (Alicot)
Figure 5:
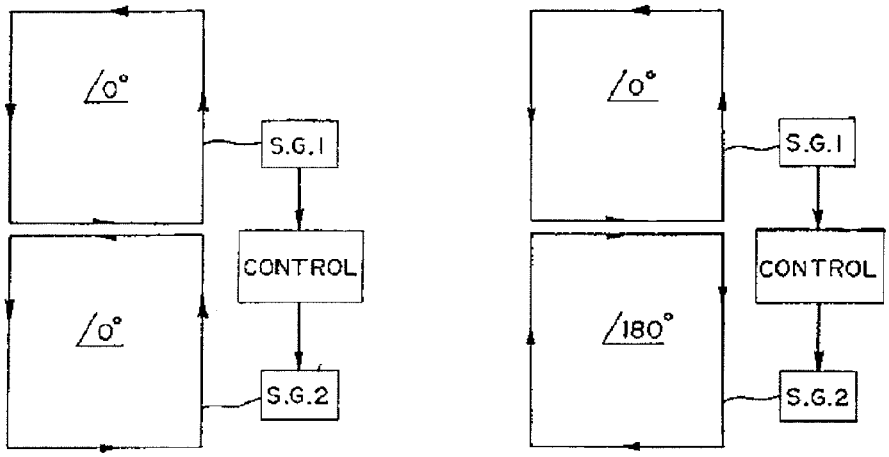
Fig. 5 (prior art)
FIG. 5 is a functional diagram of the antenna structure of FIG. 4.
Figure 6:
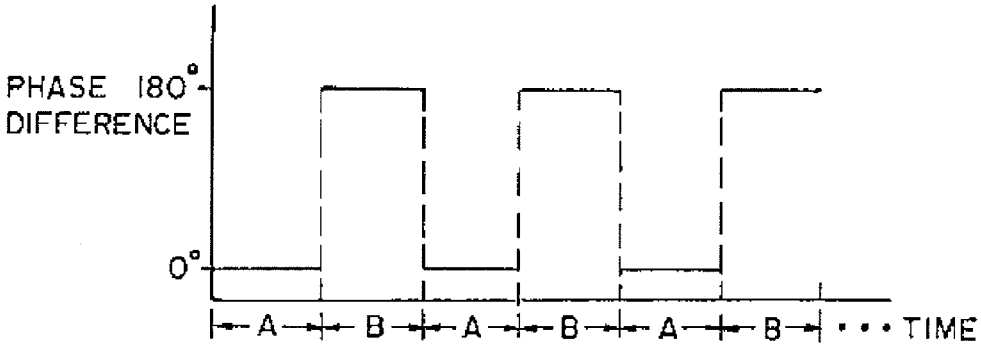
Fig. 6 (prior art)
FIG. 6 is a timing diagram for activating the antenna structure of FIGS. 4-5.
Figure 7:
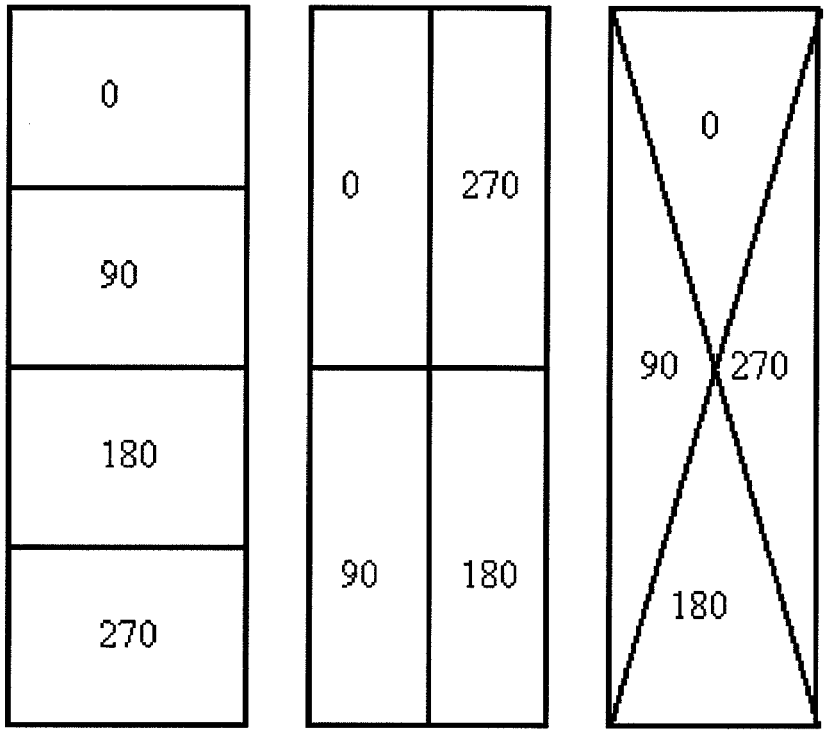
Fig. 7 (prior art)
FIG. 7 is a simplified illustration of different antenna element phasings shown in U.S. Pat. No. 6,081,238 (Alicot)
Figure 8:
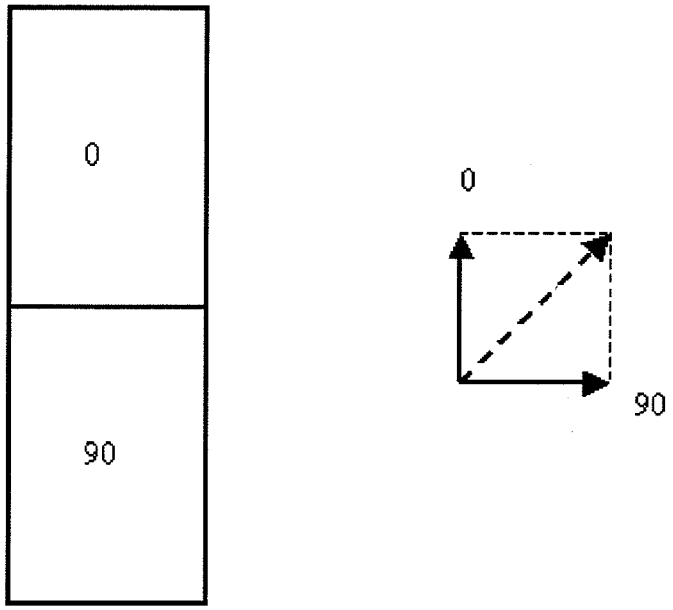
Fig. 8 (PRIOR ART)
FIG. 8 is a simplified illustration of a non-zero far-field vector summation.
Figure 9:
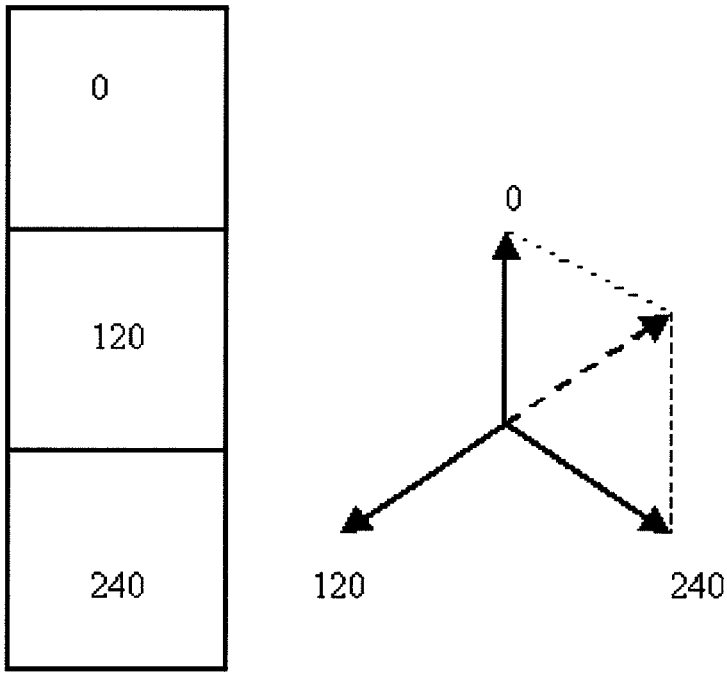
FIG. 9 is a simplified illustration of a phased method with far field cancellation of the present invention.
Figure 9A:
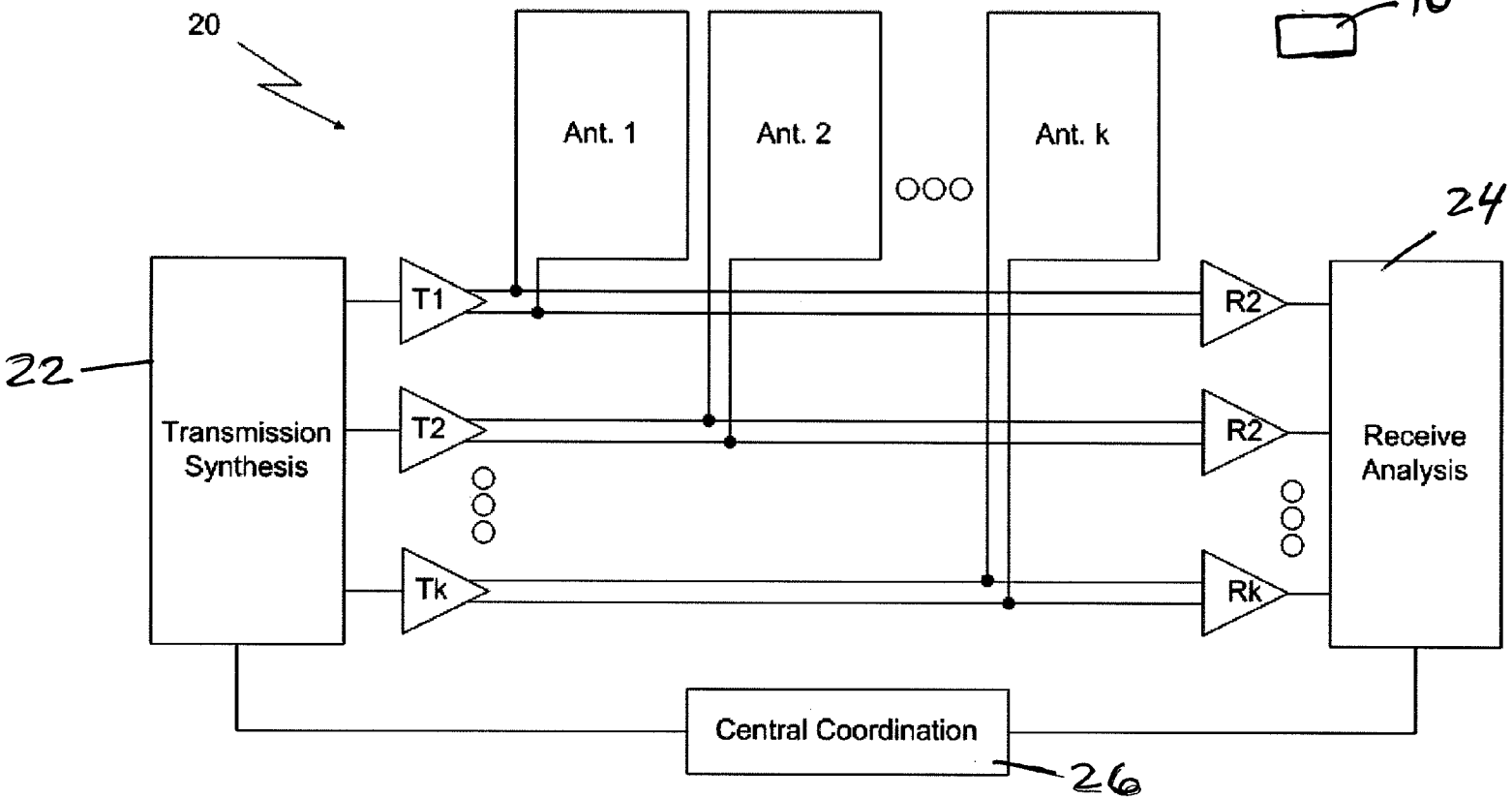
FIG. 9A depicts a block diagram of the system of the present invention.

This invention 20 (see FIG. 9A) relates to dynamically controlled electronic article surveillance (EAS) systems whereby an array of antenna elements (Ant. 1, Ant. 2 . . . Ant. K) is digitally phased and actively driven for concurrent transmission 22 and digitally phased and then combined in the receiver unit 24 to improve detection of a security tag 10. All of this is arranged from a central coordination 26 (e.g., processor). In particular, the transmit and receive interrogating field is digitally scanned such that detection may be reinforced in some desired locations and still insensitive to tag orientation suppressed in some other locations. In one manifestation of the invention, active phasing of multiple antenna elements for concurrent transmission is performed digitally using a direct digital synthesizer (DDS).

Figure 10:
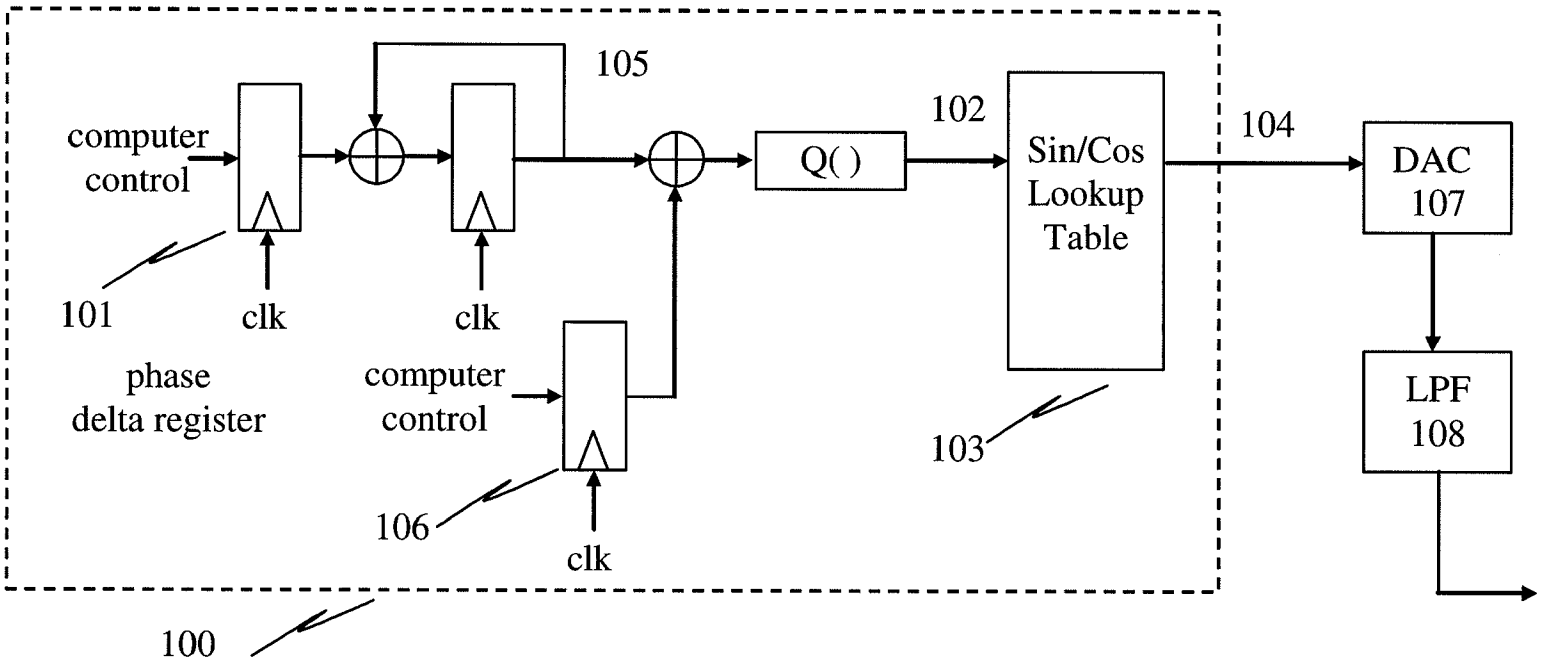
FIG. 10 is a high-level view of the direct digital synthesizer according to the present invention.

FIG. 10 shows a high-level view of the DDS 100. A phase delta 101 controlling the output frequency is accumulated (i.e., digitally-integrated in time) and quantized to generate an index 102 that is mapped by the sine/cosine lookup table 103 to generate the output RF waveform 104. After the phase accumulation 105, a desired phase offset 106 is added to the result prior to quantization. The phase delta and phase offset can be set or changed dynamically in terms of cycles per sample over a wide range of the RF spectrum.

For example, a phase delta of one tenth (1/10) and a phase offset of one hundredth (1/100) implies that in 10 time samples, one sinusoid is completed with a phase shift of 360/100 degree. The DDS output is then presented to a digital-to-analog converter (DAC) 107 and a low-pass filter 108 to yield the analog, transmit waveform. Different phase offset registers are used, one for each antenna element, to produce a digital phasing network such that the same lookup table can be time-division multiplexed to produce a plurality of RF waveforms. Furthermore, with the availability of both the sine and cosine outputs from the same lookup table, a pair of transmit signals are readily generated with a phase separation of 90°.

Figure 11:
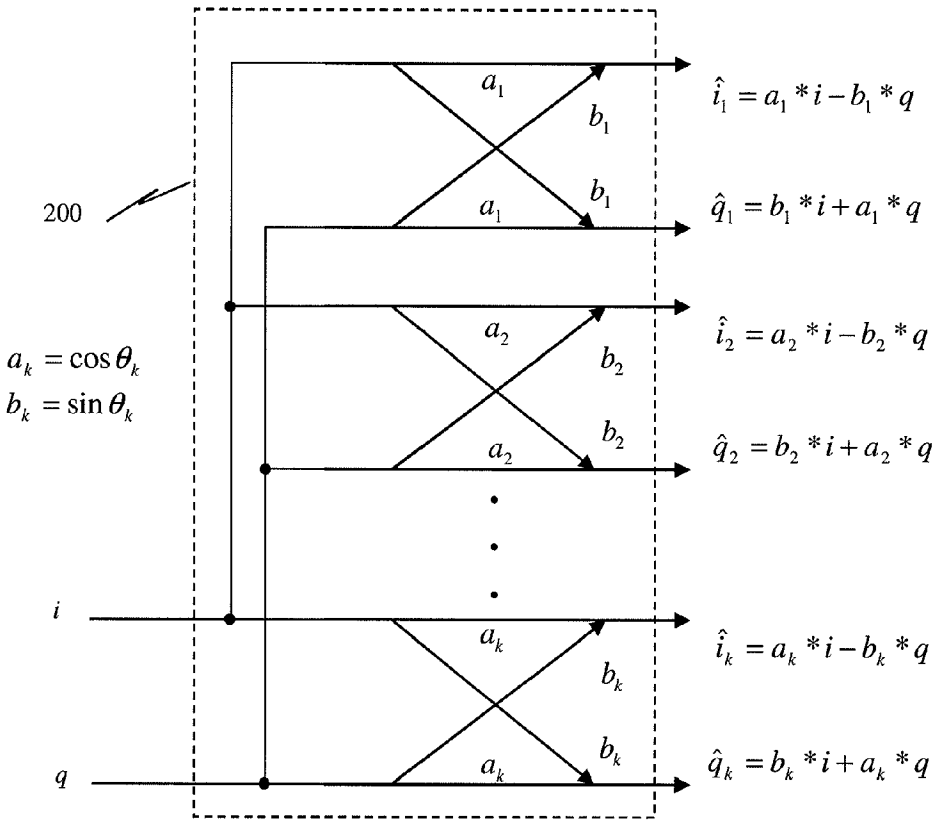
FIG. 11 is a digital phase shift network according to the present invention.
Figure 12:
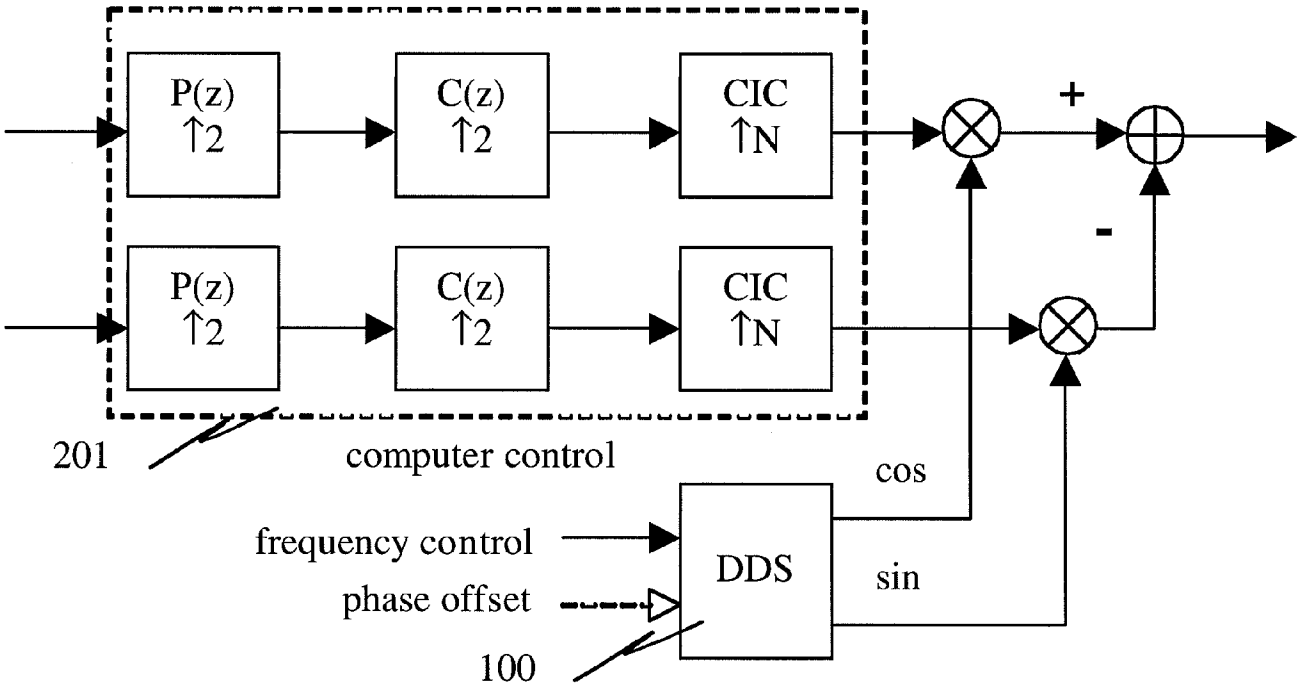
FIG. 12 is a digital up-converter according to the present invention.

In another manifestation of the invention, active phasing of multiple antenna elements for concurrent transmission is performed using a digital phase-shift, up-convert network. A template in-phase (I) and quadrature (Q) baseband signal is first designed and presented to a digital phase shift network followed by a digital up-converter (DUC). FIG. 11 a shows a digital phase shift network 200 obtained using a network of multipliers and adders to perform a plurality of vector rotations according to the rotation matrix $$\begin{bmatrix} \hat{i}_k \\ \hat{q}_k \end{bmatrix} = \begin{bmatrix} \cos\theta_k & \sin\theta_k \\ -\sin\theta_k & \cos\theta_k \end{bmatrix} \begin{bmatrix} i \\ q \end{bmatrix}$$

where [i, q] represents the template I/Q waveform, $$[\hat{i}_k, \hat{q}_k]$$

represents the rotated waveform for antenna element k, and $\theta_k$ represents the phase shift for antenna element k FIG. 12 shows a phased shifted output being up-converted in frequency using the cascade integrator comb (CIC) up-sampling filter 201 and the DDS 100. The final up-converted signal is given according to:

$$s_k(n)=\tilde{x}_k(n)\cos(\omega_0 n)-\tilde{y}_k(n)\sin(\omega_0 n)$$

where $[\tilde{x}_k, \tilde{y}_k]$ represents the CIC output for antenna element k $[\cos(\omega_0 n)\ \sin(\omega_0 n)]$ represents the DDS output, and $\omega_0$ represents the desired angular frequency of the RF waveform.

The same DDS is employed to perform the frequency up shifting for all of the transmit antenna elements. Unlike an analog phase-shift network that is appropriate for use only at a single (or narrowband) frequency, the same digital phase shift network 200 (of FIG. 11) can be used over a wide range of the RF spectrum simply by adjusting the DDS's phase delta.

Figure 13:
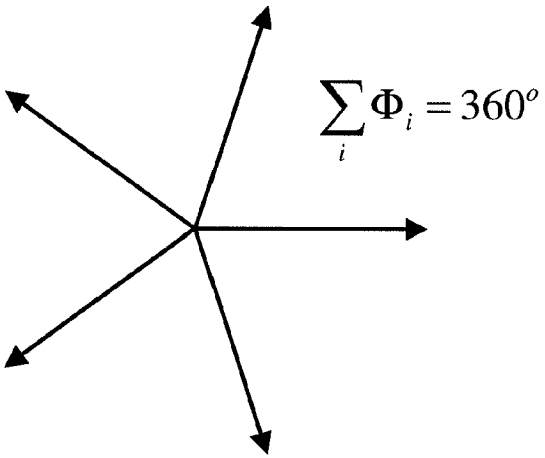
FIG. 13 is the constrained vector summation for substantial far-field suppression.

In another facet of the invention, to achieve substantial far-field suppression for regulatory compliance, the vector summation of the plurality of phase shift employed to drive the transmit antenna array must equal zero in the far field. The choice of phase shifts employed to drive the transmit antenna array is crucial not only to the pattern of the interrogating field generated, but also to the field strength far away from the antenna. In order that the far-field energy is suppressed for regulatory purposes, a constraint is imposed here as shown in FIG. 13 such that substantial far-field suppression is achieved regardless of the antenna structure and the number of antenna elements present in the system. For example, in a system with three identical antenna elements, if two of the phase shifts were 0° and 120°, then it would be desirable to choose a phase shift of 240° for the third antenna element such that the vector sum of all phase shifts equals zero.

Figure 14:
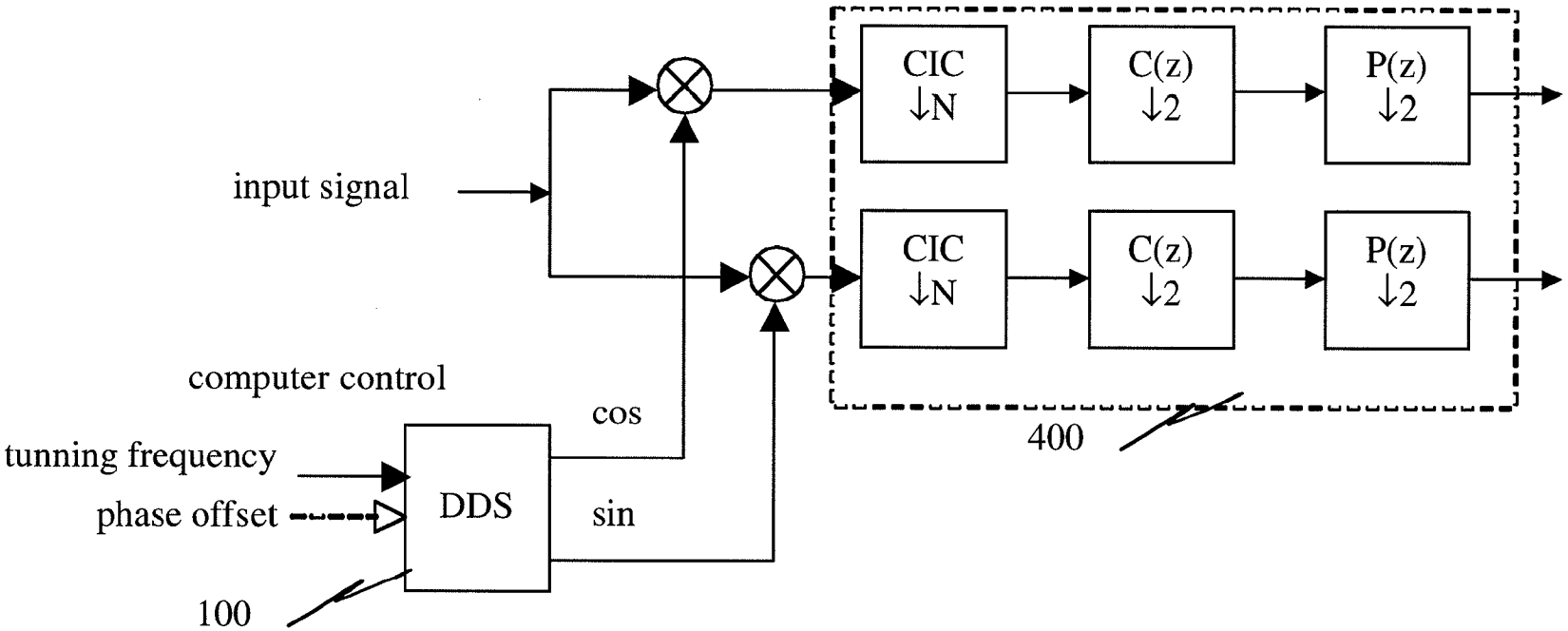
FIG. 14 shows the received signals being digitally processed using a down-convert; phase-shift network.

For another facet of the invention, the plurality of RF/IF receive signals from the antenna array are digitally processed using a down-convert, phase-shift network. The received RF signal for each antenna is presented to a digital down-converter (DDC) followed by a digital phase shifter. FIG. 14 shows a received RF signal being down-converted in frequency using the DDS 100 and the CIC down sampling filter 400. The frequency down-converted output corresponds to the baseband I/Q signal in a reverse fashion to operations in the transmit mode. The same DDS and digital phase shift network used during the transmit mode are employed in the receive mode to perform the frequency down shifting and phase shifting for all of the receive antenna elements.

Figure 15:
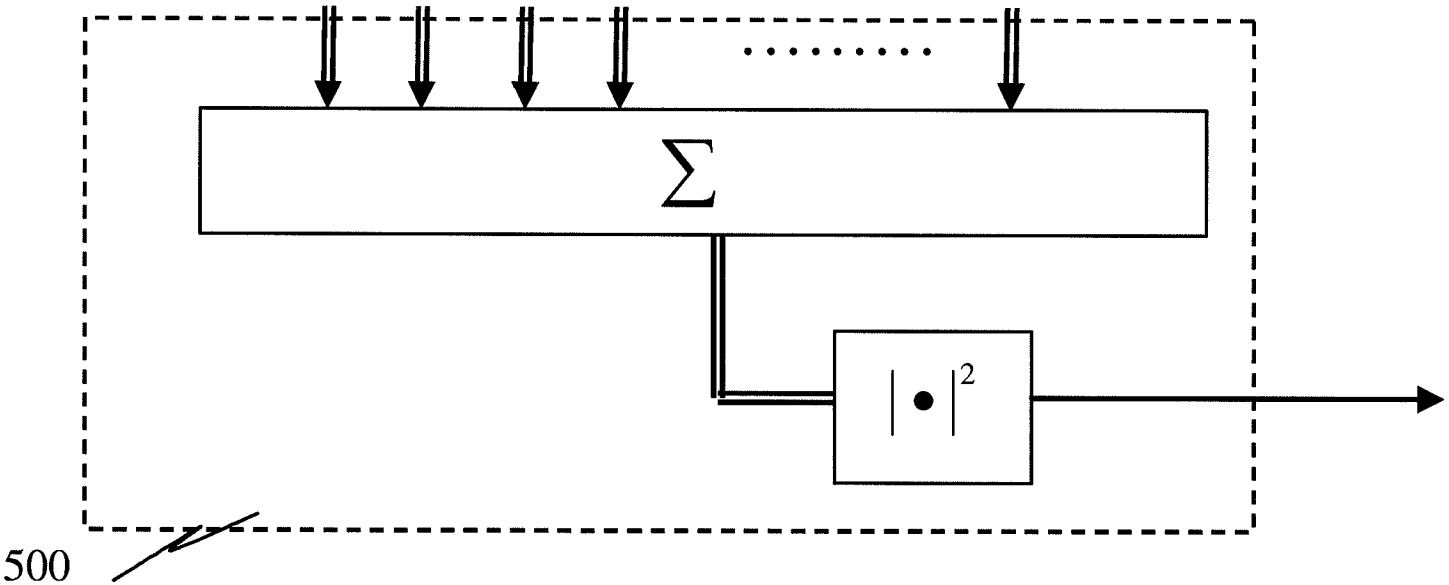
FIG. 15 is a block diagram for generating of a new composite signal computed as the square-of-sum of data for a plurality of receive antennas.

For tag detection, a composite receive signal is derived by combining the plurality of down-converted, phase-shifted, receive signals using a coherent envelope detector that performs the square-of-sum operation. FIG. 15 shows a block diagram for the generation of a new composite signal computed as the square-of-sum 500 of data for a plurality of receive antennas. For n identical elements, the summation gives a sensitivity that is n times the sensitivity of a single element. The effect of the coherent summation is to rotate and align the I/Q-vectors from the plurality of receiving antenna elements along the same direction such that the resulting vector summation equals the magnitude sum of the induced voltage on the receiving antenna elements. By varying the choice of the rotation angles, one can adjust the spatial sensitivity or directivity of the receive field as needed to detect a resonating label at different spatial coordinate and orientation with respect to the antenna array structure. This is particularly appropriate in cases where the mutual coupling between the antenna elements must be accounted for. In addition, as the angle of flux line intersection between the emitted fields vary continuously in space, the induced voltage on the receive antennas can have a mutual phase difference that depends on the location and orientation of the tag.

Figure 16:
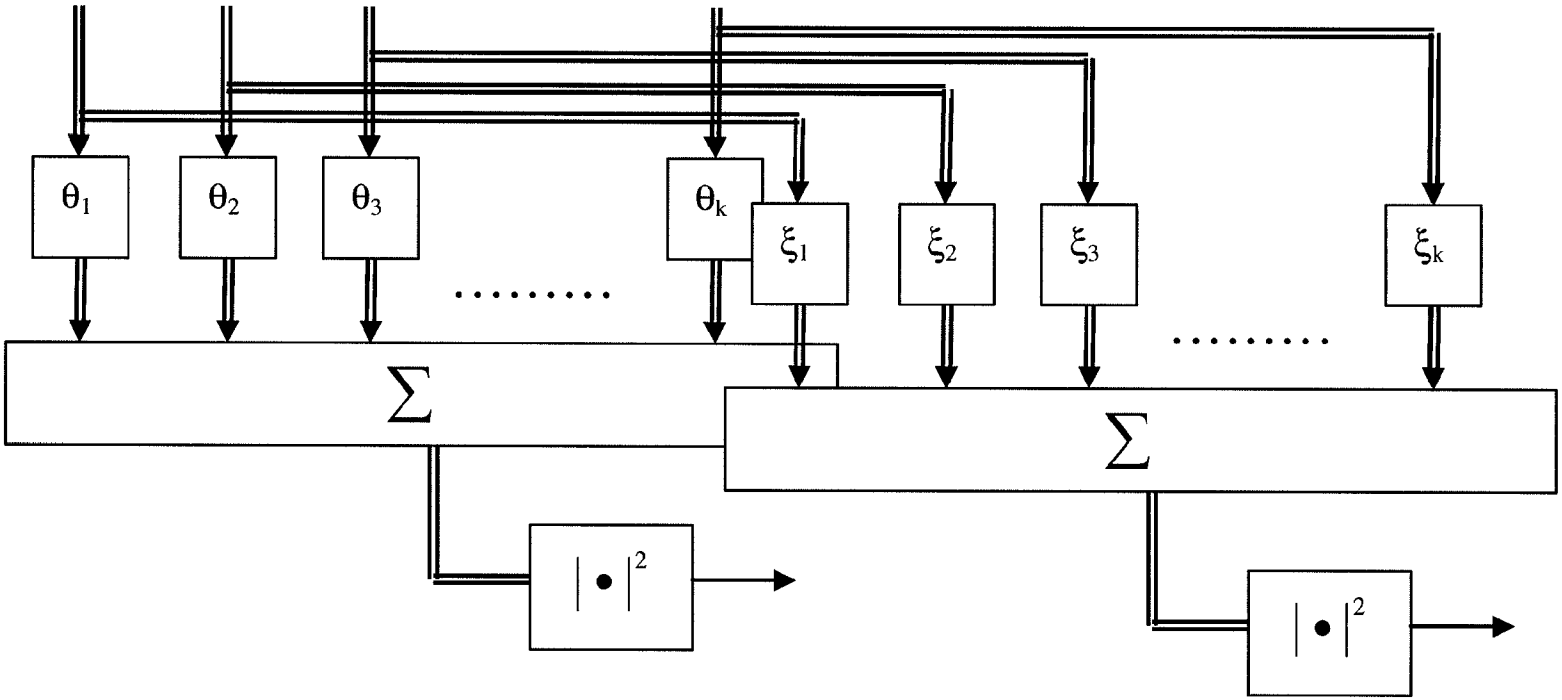
FIG. 16 shows a scheme that produces two composite receive signals derived from an array of receive antennas using two different sets of phase shifts.

The invention is also possible of creating, for tag detection, a plurality of composite receive signals derived from the many down-converted, phase-shifted, receive signals using a coherent envelope detector that performs the square-of-sum 500 operation. Because the choice of the phase shifts employed in the receive mode determines the spatial sensitivity or directivity of the receive field, different sets of phase shifts may be required to best detect a tag entering the interrogating field at different locations, especially when the signal-to-noise ratio is poor. FIG. 16 shows a scheme that produces two composite receive signals derived from an array of receive antennas using two different sets of phase shifts. The idea is that while one set of phase shifting is appropriate for the detection of a resonating tag located in a specific region, the other set is appropriate for the detection of the resonating tag located in a different region.

Figure 17:
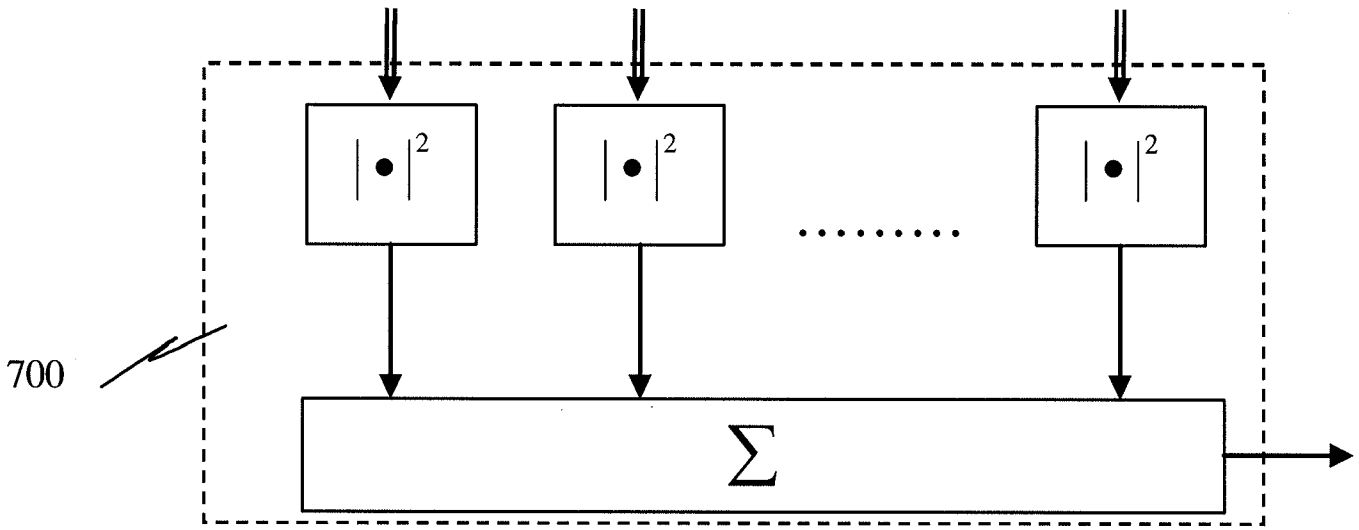
FIG. 17 shows a block diagram for generating a new composite signal computed using the sum-of-square operation on data of a plurality of receive antennas.

As another embodiment of the invention, for tag detection, a composite receive signal is derived from the plurality of down-converted signals using an incoherent envelope detector that performs the sum-of-square operation. FIG. 17 shows a block diagram for generating a new composite signal computed using the sum-of-square 700 operation on data from a plurality of receive antennas. This corresponds to having a square-law detector (envelope detector) for each antenna element and then adding the power (magnitude) from the elements to get a final signal measure. For incoherent summation, the implementation is more straightforward as compared to coherent summation but the sensitivity being $\sqrt{n}$, is somewhat less optimum compared to n for coherent summation.

Figure 18:
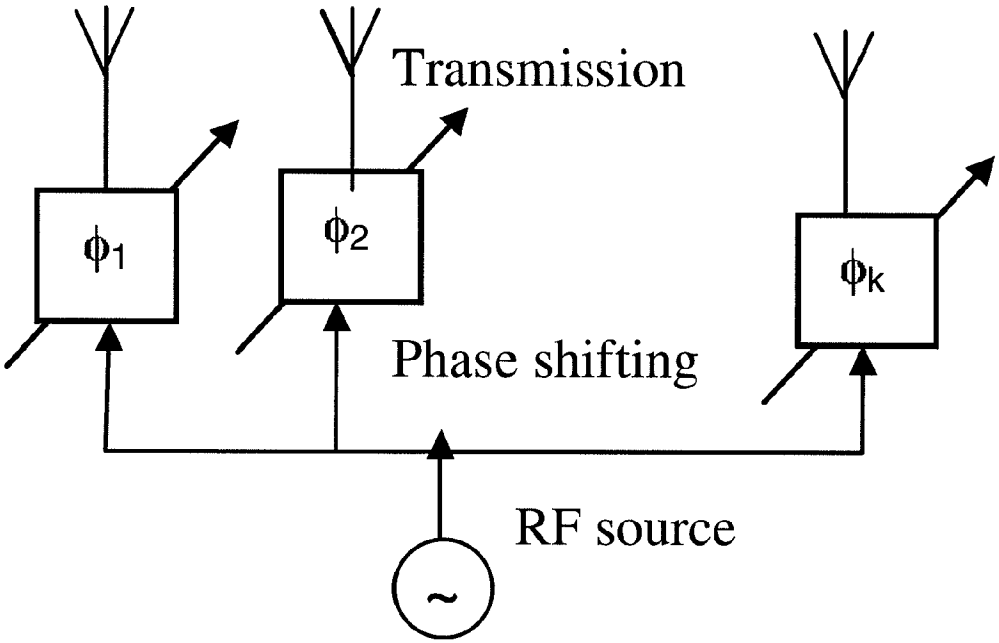
FIG. 18 shows a block diagram whereby an array of antenna elements is dynamically phased and actively driven for concurrent transmission.

The individual frequency and phase of the plurality of transmit signals are dynamically altered to allow for automated manipulation (steering) of the transmit field pattern. With the use of high-speed computer control (microcontroller, microprocessor, FPGA, etc) and a phased array antenna system, the transmit field pattern can be rapidly scanned by controlling the phasing and excitation of the individual antenna element. FIG. 18 shows a block diagram whereby an array of antenna elements is dynamically phased and actively driven for concurrent transmission. A digitally controlled array antenna can give EAS the flexibility needed to adapt and perform in ways best suited for tag detection for the particular retail store environment. Furthermore, frequency scanning is made possible with the frequency of transmission changing at will from time to time. These functions may be programmed adaptively to exercise effective automatic management such that the field pattern may be reinforced in some desired locations and suppressed in some other locations to localize the detection region.

Figure 19:
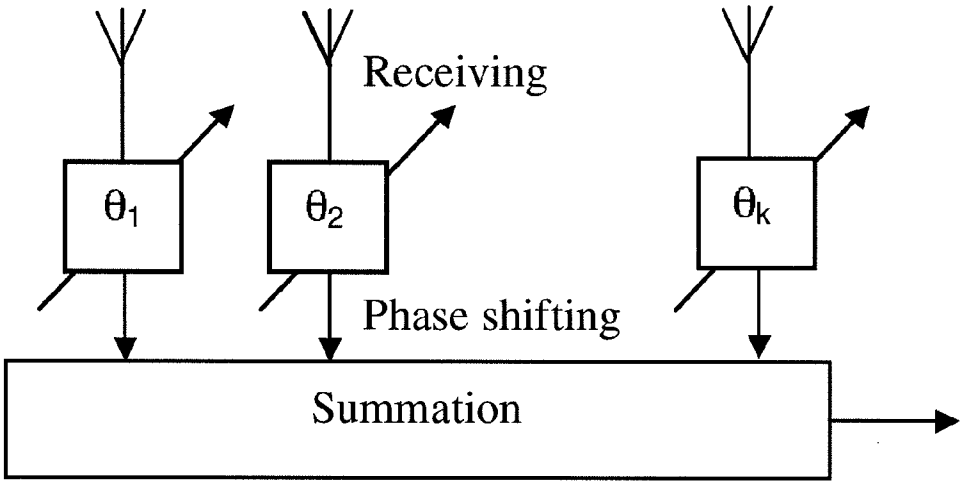
FIG. 19 shows a block diagram whereby an array of antenna elements is dynamically phased and combined in the receiver unit to improve detection.

The individual frequency and phase of the plurality of receive signals are dynamically altered to allow for automated manipulation (steering) of the receive field sensitivity. FIG. 19 shows a block diagram whereby an array of antenna elements is dynamically phased and combined in the receiver unit to improve detection. The performance oftag detection is affected by the transmit field pattern as well as the receive field sensitivity due to the law of reciprocity. In particular, for an EAS system operating in pulsed mode, a reciprocity exists between the transmit field intensity and the receive field sensitivity, in relation to the decay of field strength as distance increases. Thus, for tag detection, the dynamic phasing of the plurality of transmit signals is only effective if dynamic phasing of the plurality of receive signals is also performed.

Figure 20:
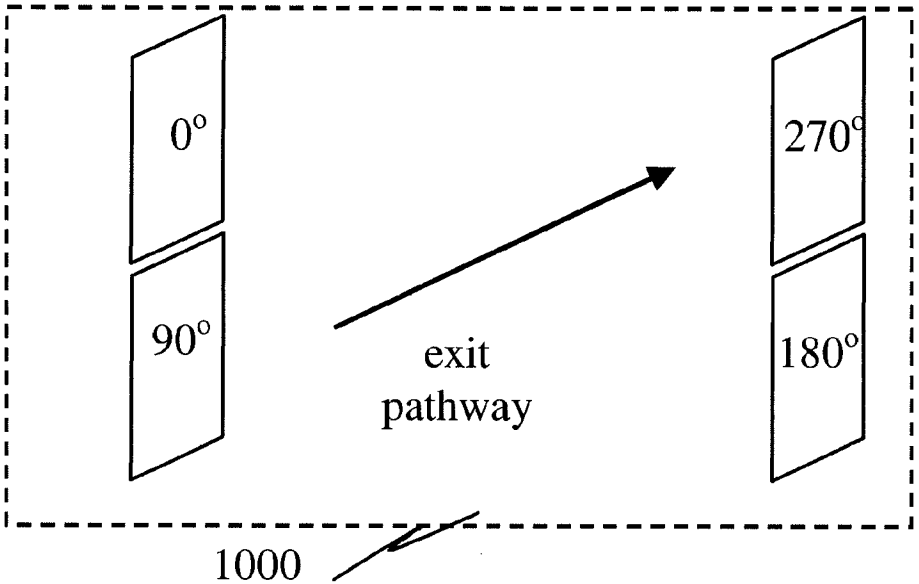
FIG. 20 illustrates a wide aisle detection scheme with dynamic phasing.

For wide aisle antenna configuration, the antenna elements are arranged to form a pedestal pair such that half of the elements having a phase shift of $0 \leq \phi_i < \pi$ are located coplanar on one side of the exit aisle while the other half of the antenna elements having a phase shift of $\pi \leq \phi_j < 2\pi$ are located coplanar on the other side of the exit aisle. In particular, FIG. 20 shows such a scheme 1000 consisting of 4 antenna elements whereby the 0° and 90° loops are arranged in a common plane on one side of the exit aisle, while the 180° and the 270° loops are arranged in a common plane on the other side. Note that the sum of all the transmit phases is 360° so that the far-field emission is substantially reduced.

Figure 21:
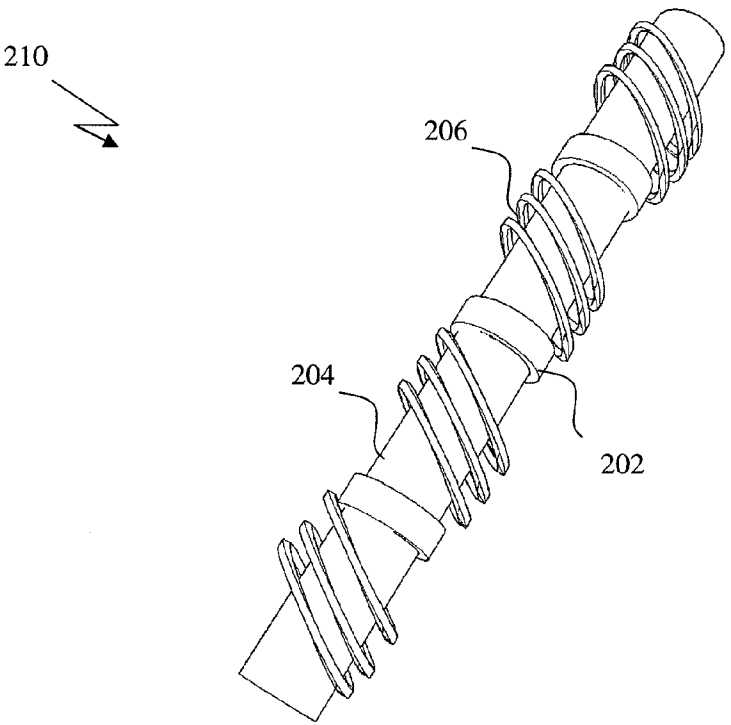
FIG. 21 depicts an exemplary antenna element comprising windings about an electromagnetic core, such as a ferrite ceramic material.

The antenna structures for the dynamic EAS system can be constructed in a variety of ways. For instance, rather than being constructed as air-loops, antenna elements 210 may consist of windings 206 about electromagnetic cores 204, such as a ferrite ceramic material, separated by non-ferrous spacers 202 such as shown in FIG. 21. Distinct loops may share a common core or be linearly disposed on adjacent or nearly adjacent segments of material, or in a variety of other arrangements.

While the invention has been described in detail and with reference to specific examples thereof, it will be apparent to one skilled in the art that various changes and modifications can be made therein without departing from the spirit and scope thereof.

What is claimed is:

1. A method for detecting an electronic article surveillance tag while reducing far field electromagnetic fields, said method comprising:

providing an antenna structure having a plurality of antenna elements wherein each antenna element comprises a respective transmission driver for driving its respective antenna element to emit a respective electromagnetic field; and driving each one of said transmission drivers with a respective transmission signal to generate a respective electromagnetic field vector and wherein a sum of said electromagnetic field vectors adds to zero regardless of said antenna structure and the number of said antenna elements, and wherein no vector is separated from another vector by 90° or 180°, said driving step comprising digitally-phase shifting said transmission signal and then digitally up-converting said transmission signal; and receiving a plurality of receive signals from the tag that are digitally down-converted and then digitally-phase shifted.

2. The method of claim 1 further comprising the step of deriving a composite receive signal from said receive signals that are digitally down-converted and digitally-phase shifted using coherent envelope detection.

3. The method of claim 1 wherein said coherent envelope detection implements a square-of-sum operation.

4. The method of claim 1 further comprising the step of generating a plurality of composite receive signals for detecting the tag in different regions.

5. The method of claim 1 further comprising the step of deriving a composite receive signal from said receive signals that are digitally down-converted and digitally-phase shifted using incoherent envelope detection.

6. The method of claim 1 wherein said step of providing an antenna structure having a plurality of antenna elements comprises providing an antenna structure having three or more loops.

7. The method of claim 1 wherein said step of providing an antenna structure having a plurality of antenna elements comprises providing an antenna structure having an electromagnetic core structure about which loops of said antenna structure are wound.

8. The method of claim 7 wherein said step of providing an antenna structure having an electromagnetic core structure comprises providing an electromagnetic core of either ferrite ceramic material or a composite ferrous and insulating material.

9. The method of claim 1 wherein said step of driving each one of said transmission drivers comprises automatically steering said electromagnetic fields and scanning associated frequencies by rapidly varying an individual frequency and phase of a plurality of transmitted and received electronic article surveillance tag signals.

10. The method of claim 9 wherein said step of automatically steering said electromagnetic fields and scanning associated frequencies further comprises digitally phasing and dynamically controlling said plurality of transmitted and received electronic article surveillance tag signals to form a circularly polarized helical RF field.

* * * * *